US008245461B2

(12) United States Patent
Wei

(10) Patent No.: US 8,245,461 B2
(45) Date of Patent: Aug. 21, 2012

(54) PROTECTING WALL BOARD ASSEMBLY FOR HOUSES

(76) Inventor: Marshall Wei, Houston, TX (US)

( * ) Notice: Subject to any disclaimer, the term of this patent is extended or adjusted under 35 U.S.C. 154(b) by 8 days.

(21) Appl. No.: 12/925,000

(22) Filed: Oct. 12, 2010

(65) Prior Publication Data

US 2012/0085044 A1 Apr. 12, 2012

(51) Int. Cl.
*E06B 9/02* (2006.01)

(52) U.S. Cl. ..... 52/202; 52/716.8; 52/208; 52/204.1; 52/455; 52/656.7

(58) Field of Classification Search ..... 52/202, 52/203, 204.1, 204.71, 716.8, 800.12, 800.13, 52/717.05, 506.1, 506.06, 208, 210, 213, 52/455, 656.4, 656.5, 656.6, 656.7; 160/371, 160/372, 377, 353, 368.1, 396
See application file for complete search history.

(56) References Cited

U.S. PATENT DOCUMENTS

| | | | | | |
|---|---|---|---|---|---|
| 3,349,533 | A * | 10/1967 | Gregoire | 52/716.8 |
| 3,363,390 | A * | 1/1968 | Crane et al. | 52/716.8 |
| 3,382,615 | A * | 5/1968 | Adell | 49/462 |
| 3,392,498 | A * | 7/1968 | Rogers | 52/395 |
| 3,416,282 | A * | 12/1968 | Daugherty | 52/716.8 |
| 3,456,410 | A * | 7/1969 | Johnson et al. | 52/309.1 |
| 4,092,813 | A * | 6/1978 | Eggert | 52/716.5 |
| 4,105,814 | A * | 8/1978 | Eggert | 428/122 |
| 4,612,743 | A * | 9/1986 | Salzer | 52/208 |
| 4,625,490 | A * | 12/1986 | Baslow | 52/717.05 |
| 4,685,261 | A * | 8/1987 | Seaquist | 52/202 |
| 5,477,646 | A * | 12/1995 | Dietz et al. | 52/202 |
| 5,768,833 | A * | 6/1998 | Golen | 52/202 |
| 5,860,264 | A * | 1/1999 | Gephart et al. | 52/656.4 |
| 6,269,597 | B1 * | 8/2001 | Haas | 52/203 |
| 6,367,223 | B1 * | 4/2002 | Richardson et al. | 52/656.9 |
| 6,550,193 | B2 * | 4/2003 | Potts | 52/204.1 |
| 7,802,408 | B2 * | 9/2010 | Asbury | 52/282.4 |
| 2004/0182024 | A1 * | 9/2004 | Varley et al. | 52/243.1 |
| 2006/0179737 | A1 * | 8/2006 | Trundle | 52/202 |
| 2007/0107328 | A1 * | 5/2007 | Munch | 52/202 |
| 2007/0181273 | A1 * | 8/2007 | Koutsoukos | 160/371 |
| 2008/0313981 | A1 * | 12/2008 | Donley et al. | 52/203 |

FOREIGN PATENT DOCUMENTS

| | | |
|---|---|---|
| TW | 489927 | 6/2002 |

* cited by examiner

*Primary Examiner* — Robert Canfield
*Assistant Examiner* — Babajide Demuren

(57) ABSTRACT

A protecting wall board assembly for houses, including two "⊔" shaped column and a plurality of hollow flat plates. The "⊔" shaped column has a guiding slot and corresponding first arm and second arm. The first arm is connected with a bent section. The second arm is connected with a protruding rib. Corresponding first engaging portion and second engaging portion are provided on an upper end portion and a lower end portion of the hollow flat plate. A plurality of hollow flat plates are accommodated in the guiding slot of the two "⊔" shaped column, and are fixedly joined together with the first and second engaging portions. The hollow flat plates are fixed between the bent section and the protrusion tube. The parts are of simple structure, can be easily manufactured, assembled, and disassembled, and can be used for the windows and doors having different widths and heights.

1 Claim, 3 Drawing Sheets

PROTECTING WALL BOARD ASSEMBLY FOR HOUSES

FIELD OF THE PRESENT INVENTION

This invention relates to a protecting wall board (plate) assembly, particularly to a safety equipment assembly for houses to minimize the damages and losses of the houses and the properties in the houses due to hurricanes or floods.

BACKGROUND OF THE PRESENT INVENTION

Most of the conventional houses do not have pre-assembled protecting wall board assembly. Before the approaching of the hurricanes or typhoons, some people temporarily use bolts, nails, or screws to fasten wood boards, plywood boards and/or metal boards outside of the doors or windows to protect the doors, windows, or the glass from being damaged. The boards need to be removed one by one after the hurricane and this is tedious and time-consuming.

Some of the conventional houses use high-priced assembled sheets or integral protecting boards (made of e.g. aluminum, wood, plywood, metal, or concrete) which are made according to the shapes and sizes of the doors, or windows, and which can be fixed to the outside of the doors and windows and can be removed there from for being used next time. These assembled sheets, or integral protecting boards are costly to manufacture, are complicated, are not of good-looking, and may block the light and sight. This is why these assembled sheets or integral protecting boards are not widely accepted by the consumers.

Please see the cited prior art Taiwanese Publication number 489,927 which discloses an improved structure of a gate for stopping water from entering the houses. It includes two "⊓" shaped slotted columns, a light-weighted water-blocking board made of water-resistant material, and a bottom slot embedded in the ground and being flush (in the same plane) with the horizon. A plurality of engaging-abutting portions are provided on one side of the internal recesses of the slotted columns which are provided with some threaded holes so as to position an adjusting handle. The water-blocking board are light-weighted water-resistant board. Engaging-abutting portions are provided on external sides of the two ends of the water-blocking board. A concave bottom is embedded below the above-mentioned slotted columns.

The above-mentioned slotted columns in the Taiwan publication '927 needs to incorporate the engaging-abutting portions, the adjusting handle, and some filling material need to be provided on the lower edge of the water-blocking board and the internal sides of the two ends thereof. Moreover, engaging-abutting portions need to be fixedly provided on the external sides of the two ends of the water-blocking board. The structure of this prior art is very complicated, and the manufacturing cost is relatively high.

SUMMARY OF THE PRESENT INVENTION

An objective of the present invention is to provide an improved safe protecting wall board assembly for houses, which provides better practical function.

The main objective of the present invention is to provide a protecting wall board (plates) assembly for houses. This assembly employs two "⊓" shaped columns, a plurality of hollow flat plates, and two resilient soft tubes to form a protecting wall board device. The structures of each of the elements are simple, the manufacturing is simple and can save cost.

Furthermore, the assembling and disassembling of the elements are easy. Moreover, this protecting wall board device can be easily used for doors and windows having different heights and widths.

Another objective of the present invention is to provide a protecting wall board assembly for houses which can prevent strong wind from damaging doors, windows, glass, and which can block the flooding water so that the indoor can be prevented from being flooded.

The other objectives and advantages of this invention will be described in details as follows. Please refer to the drawings and embodiments.

DETAILED DESCRIPTION OF THE PRESENT INVENTION

Figure 1:
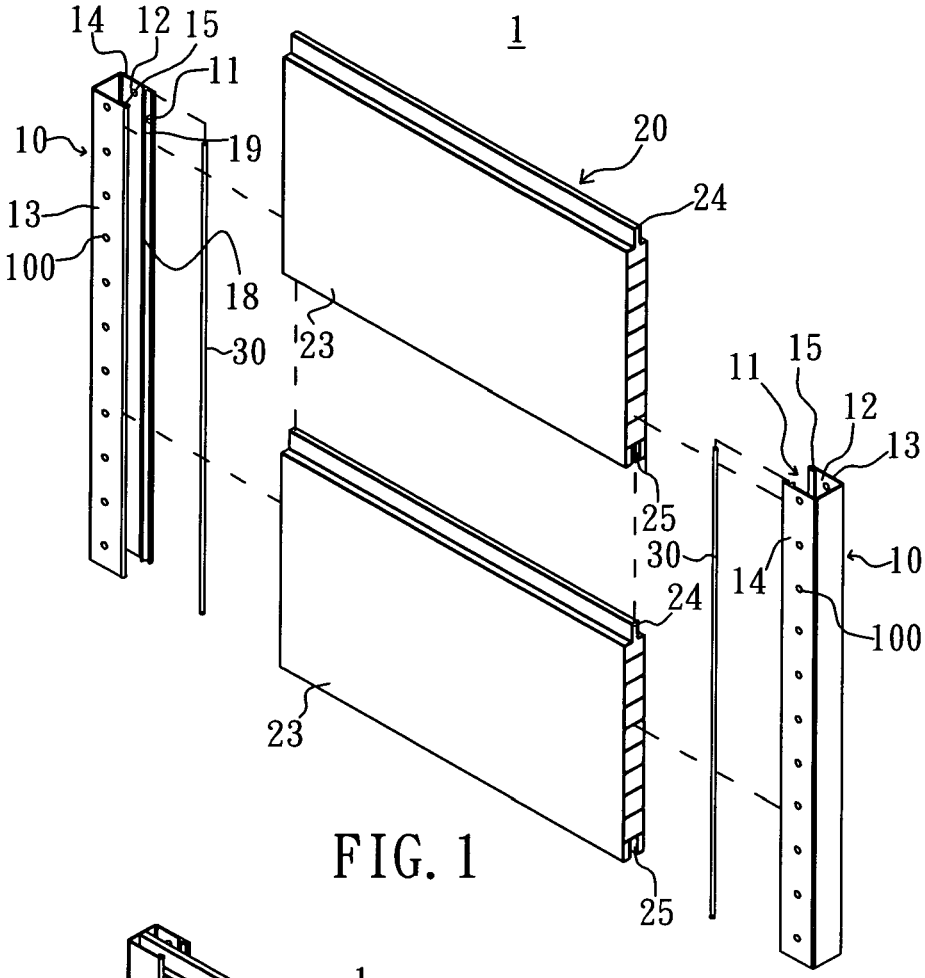
FIG. 1 is an exploded schematic view of the protective wall board assembly for houses of the present invention.
Figure 2:
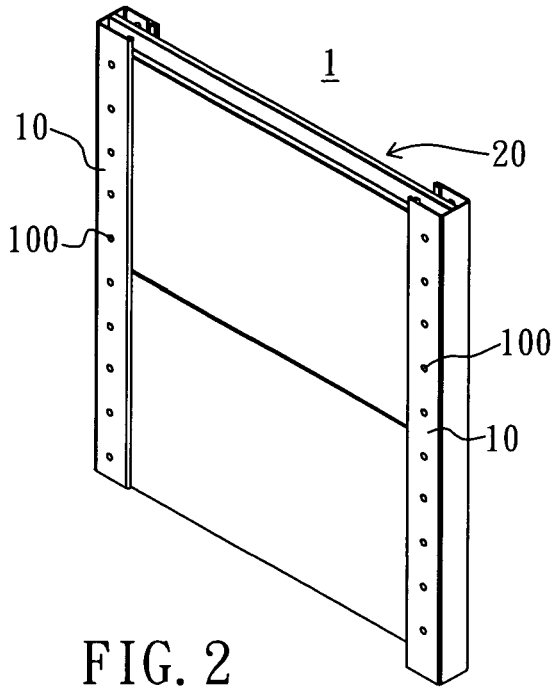
FIG. 2 is an exterior schematic view of the protective wall board assembly for houses of the present invention.

As shown in FIGS. 1 and 2, designating numeral 1 general designates the protective wall board assembly of the present invention. This assembly 1 includes at least two "⊔" shaped columns 10, a plurality of hollow flat plates 20, and two resilient soft tubes 30.

Figure 3:
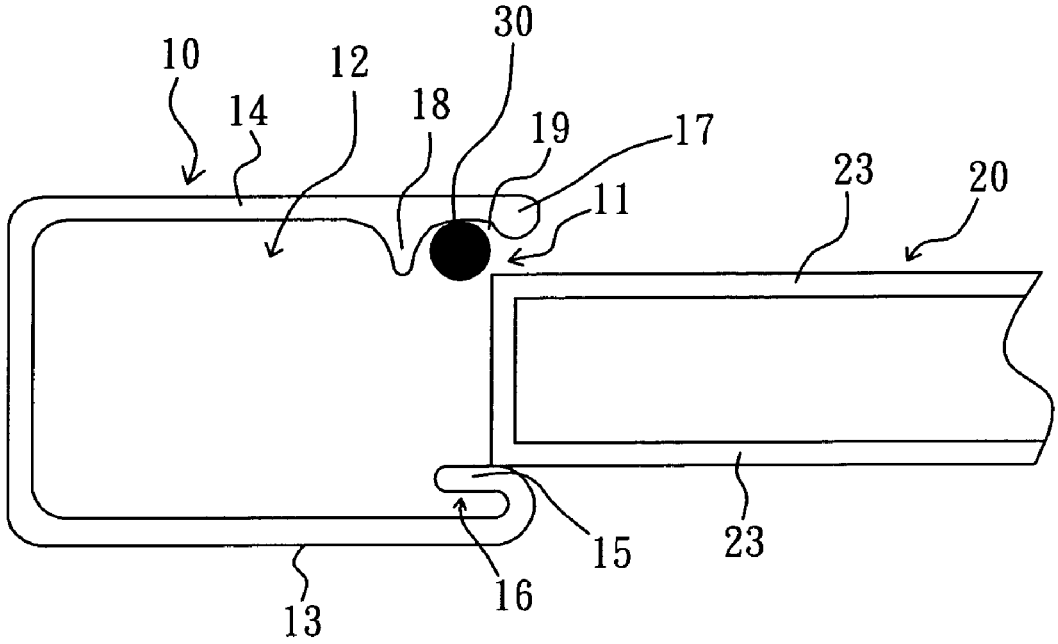
FIG. 3 is a schematic view of the "⊓" shaped column and hollow flat plate before they are assembled.

As shown in FIGS. 1 and 3, the "⊔" shaped column 10 has an opening 11 and a guiding slot 12 communicating with the opening 11. The "⊔" shaped column 10 has a corresponding first arm 13 and a second arm 14. The first arm 13 is connected at a position near the opening 11 with a bent section 15 which bends toward the inside of the guiding slot 12. A spacing 16 is formed between the bent section 15 and the first arm 13 so that the bent section 15 has a flexible moving space. The second arm 14 is connected (at a position near the opening 11) with a protrusion 17 and a protruding rib 18 which protrude toward the first arm 13. The protruding rib 18 is further away from the opening 11 than the protrusion 17. A recessed slot 19 is formed between the protruding rib 18 and the protrusion 17. The recessed slot 19 corresponds to the bent section 15. A plurality of fastening holes 100 art provided on the "⊔" shaped column 10.

Figure 5:
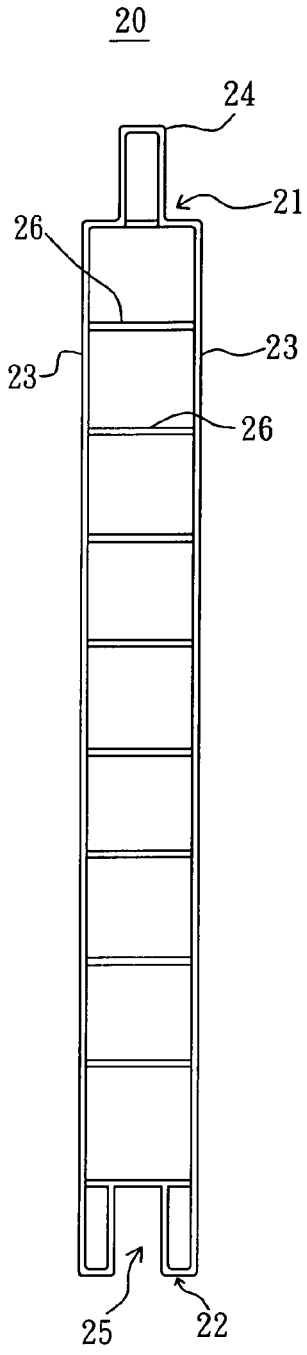
FIG. 5 is a side schematic view of the hollow flat plate used in the present invention.

As shown in FIGS. 1, 3, and 5, the hollow flat plate 20 has an upper end portion 21, a lower end portion 22, and two end faces 23. The width between the two side end faces 23 is slightly smaller than the width of the opening 11. A first engaging portion 24 and a second engaging portion 25 are provided on the upper end portion 21 and the lower end portion 22 of the hollow flat plate 20, respectively.

A plurality of partition plate 26 are provided between the side end faces 23 and connected thereto, so as to strengthen the hollow flat plate 20. The first engaging portion 24 and the second engaging portion 25 can be corresponding protrusion and recess, respectively, which can engage each other.

Figure 4:
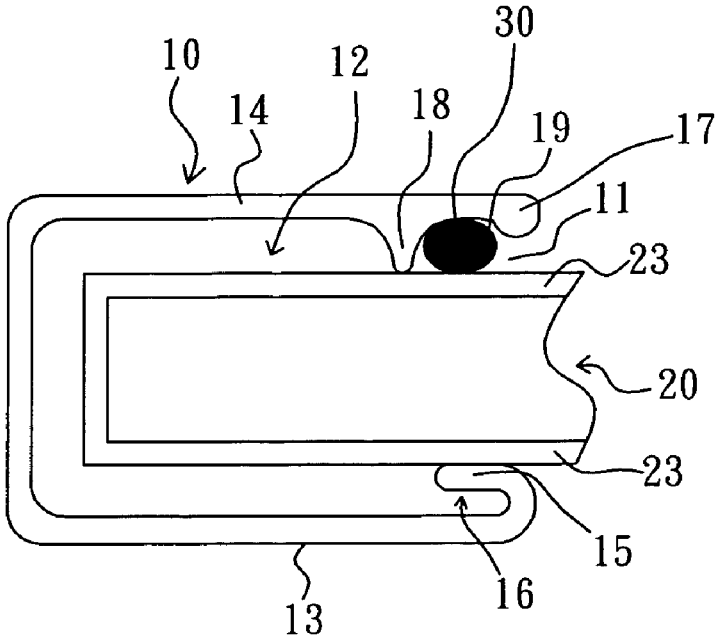
FIG. 4 is a schematic view of the "⊓" shaped column and hollow flat plate after they are assembled.

As shown in FIGS. 1, 2, and 4, the two ends of the hollow flat plates 20 are accommodated in the guiding slots 12 of the two "⊔" shaped columns 10 respectively. Two adjacent hollow flat faces 20 are fixedly connected with the first engaging portion 24 and the second engaging portion 25. A plurality of hollow flat plates 20 are fixed between the bent section 15 and the protection rib 18. The recessed slot 19 of the "⊔" shaped column 10 accommodates a resilient soft tube 30 which tightly contacts a side end face 23 of the hollow flat plate 20 so that a hermetic effect can be achieved between the second arm 14 and a plurality of hollow flat plate 20. A hermetic effect can also be achieved between the first arm 13 and a plurality of hollow flat plates 20 through the tight contact of the resilient bent section 15 and the other side end face 23 of the hollow flat plate 20.

Figure 6:
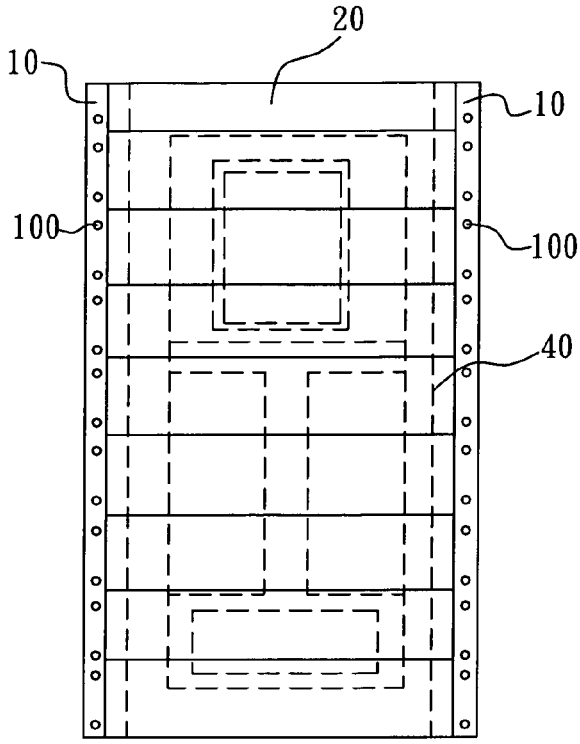
FIG. 6 is a schematic view of a first application (embodiment) of the protective wall board assembly for houses of the present invention.
Figure 7:
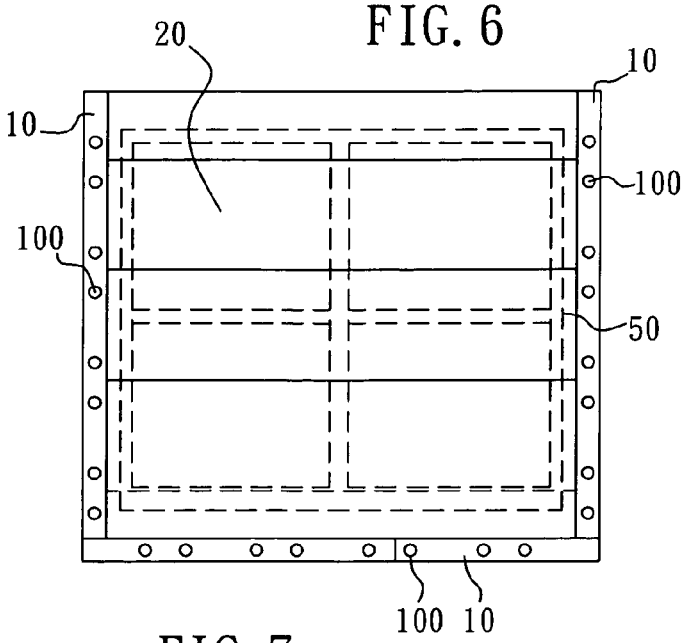
FIG. 7 is a schematic view of a second application (embodiment) of the protective wall board assembly for houses of the present invention.

Please refer to FIGS. 1, 4, 6, and 7. FIG. 6 shows one embodiment of the protective wall plate assembly of the present invention which is according to the height of a door frame 40, FIG. 7 shows another embodiment of the protective wall plate assembly of the present invention which is according to the height of the window frame 50. A cutting machine is used to cute the "⊔" shaped column 10 to a desirable height. Then, screws, bolts and/or other fasteners are inserted through the fastening holes 100 of the "⊔" shaped column 10 so that two "⊔" shaped column 10 can be fixed on the two sides of the door frame 40 or the two sides of the window frame 50. As shown in FIG. 7, the lower end of the lowest hollow flat plate 20 is accommodated in another "⊔" shaped column 10 which is located at the lower end of the window frame 50, and is fastened between the bent section and the protruding rib of another "⊔" shaped column 10. The widths and the heights of the hollow first plates 20 can be cut so as to fit the width and the height of the door frame 40 or the window frame 50.

Before the hurricane or the typhoon is coming, several hollow flat plates 20 can be fitted between the "⊔" shaped columns 10 so that each of the adjacent hollow flat plates 20 can engage with each other, thus the window and the door can be protected from the wind. If it's possible that there will be some flooding, the resilient soft tubes 30 can be applied and tightly contact one side end face 23 of the hollow flat plate 20 so that a hermetic effect can be achieved between the second arm 14 and several hollow flat plates 20. Filling material such as silicone or the like can be applied at the engaging portions of the adjacent hollow flat plates 20, and the fastening holes 100 so that the window and the door can be protected from the flooding.

The "⊔" shaped column 10 of the present invention is made of strong plasticizable plastics, and is extruded with extruder or the like. The inner width of the "⊔" shaped column is stable and the resilient bent section thereof can tightly contact the side end face of the hollow flat.

Plate without any gap so that a hermetic effect can be achieved between the first arm and the hollow flat plate.

The resilient soft tube in the present invention can be made of TPR (thermoplastic rubber) or the like material and is water resistant.

The hollow flat plates in this invention have the function of protecting the door and the window from wind and water. They can be extruded with high temperature vacuum extruder, using plasticizable plastics. The hollow flat plate is of high tenacity, low specific weight, and is better than conventional material in terms of the physical property and manufacturing cost. The upper end and the lower end of the hollow flat plates have structures that can be easily engaged or disengaged. The height of the hollow flat plates can be readily adjusted, and can be readily assembled or disassembled. The hollow flat plates have smooth surfaces and can provide thermal insulation. They can also be made of light-penetratable material and they are of high quality.

The protective wall board (plate) assembly of this invention can incorporate the outer wall of the houses, the window frame, or the door frame so as to minimize the damages from the hurricanes or the flooding.

The "⊔" shaped columns, the hollow flat plates, and the resilient soft tubes used in this invention are of simple structure, easy to manufacture, assemble, and disassemble, and can accommodate windows or doors of different widths and heights.

The above-mentioned description is for the purpose of illustrating the embodiments of the present invention only.

The invention claimed is:

1. A protective wall board assembly for houses, including:

two "⊔" shaped columns having an opening and a guiding slot communicating with the opening;

a corresponding first arm and a second arm provided on the "⊔" shaped columns;

a bent section which bends toward the inside of the guiding slot being connected to the first arm at a position near the opening and terminating before the bottom of the "U" shaped column, in which a spacing is formed between the bent section and the first arm, so that the bent section has a flexible moving space, a protruding rib which protrudes toward the first arm being connected to the second arm at a position near the opening;

a plurality of hollow flat plates each having an upper end portion, a lower end portion, and two side end faces, in which the width between the two side end faces is slightly smaller than the width of the opening; and a first engaging portion and a second engaging portion being provided on the upper end portion and the lower end portion of the hollow flat plates respectively;

in which the two ends of the hollow flat plates are accommodated in the guiding slot of the "⊔" shaped columns respectively, two adjacent hollow flat plates are fixedly joined with the engagement between the first engaging portion and the second engaging portion, and the hollow flat plates are fixed between and contact the bent section and the protruding rib;

in which a protrusion which protrudes toward the first arm is connected to the second arm, the position of the protruding rib is farther away from the opening than that of the protrusion, in which a recessed slot is formed between the protruding rib and the protrusion, the recessed slot corresponds to the bend section for accommodating one resilient soft tube which tightly contacts a side end face of the hollow flat face so as to achieve a hermetic effect between the second arm and the hollow flat plates;

in which the resilient soft tube can be moved between the protrusion and the protruding rib on the recessed slot when the hollow flat plate is being moved.

* * * * *